US005581980A

United States Patent [19]

Halm

[11] Patent Number: 5,581,980

[45] Date of Patent: Dec. 10, 1996

[54] PROCESS FOR PRODUCING A STICK OF ADHESIVE

[75] Inventor: Hans Halm, Herne, Germany

[73] Assignee: UHU GmbH, Germany

[21] Appl. No.: 268,300

[22] Filed: Jun. 29, 1994

[30] Foreign Application Priority Data

Jul. 1, 1993 [DE] Germany ..... 43 21 966.7

[51] Int. Cl.[6] ..... B65B 43/00

[52] U.S. Cl. ..... 53/452; 53/471; 29/413; 29/416; 264/157

[58] Field of Search ..... 29/413, 416, 527.3; 264/138, 157; 401/68, 75, 79; 53/452, 471

[56] References Cited

U.S. PATENT DOCUMENTS

| | | | |
|---|---|---|---|
| 2,887,253 | 5/1959 | Biedenstein . | |
| 4,437,589 | 3/1984 | Potter . | |
| 4,863,300 | 9/1989 | Arona-Delonghi | 401/75 X |
| 4,890,944 | 1/1990 | Cousins et al. | 401/68 X |

FOREIGN PATENT DOCUMENTS

| | | | |
|---|---|---|---|
| 0351933 | 1/1990 | European Pat. Off. . | |
| 2559135 | 8/1985 | France . | |
| 1281886 | 7/1972 | United Kingdom | 401/75 |

*Primary Examiner*—S. Thomas Hughes
*Attorney, Agent, or Firm*—Graham & James LLP

[57] ABSTRACT

A process for producing a stick of adhesive, having a rotatable base part with rotary spindle, which spindle is engaged in a holding element for the stick material (plunger, small basket, anchoring disc), which holding element is fitted into a sleeve surrounding the stick material. The rotary spindle, provides controlling movement of the stick-shaped adhesive material either up or down. The sleeve (2) together with the plunger (1) is formed in a one-part injection molding which is joined, via predetermined breaking points (3), to the sleeve wall. For the assembly, the base part, with rotary spindle is pushed through a centered recess in the plunger until the lower periphery of the sleeve comes to rest against the upper part of the base part. The adhesive stick material is then poured into the unit thus formed (sleeve, plunger and base part with rotary spindle), and, after the filling operation is complete, the rotatable base part is actuated and, as a result, the plunger is lifted into the intended end position (10), with tearing off of the predetermined breaking points. The structural arrangement for carrying out the process, consists of: a) a rotatable base part (7), a rotary element (7B) and a rotary spindle (7A), the base part having two support plates (9A, 9B), and b) a one-part injection molding, comprising a sleeve part (2) which is open at both ends and a plunger (1) with predetermined breaking points (3).

1 Claim, 1 Drawing Sheet

PROCESS FOR PRODUCING A STICK OF ADHESIVE

FIELD OF THE INVENTION

This invention relates to the production of sticks of adhesive, having a rotatable base part with rotary spindle which engages in a holding element for the stick material, which holding element is, for example, in the form of an anchoring plate, a plunger or a small basket. The invention particularly relates to holding elements which are firmly fitted into an outer sleeve which protects the stick material against drying out and against damage.

BACKGROUND OF THE INVENTION

In the production of the aforementioned adhesive sticks, difficulties have arisen with the rapid assembly of the adhesive stick structures before the filling with the adhesive material in the stick form.

The outer sleeve, the holding element and the base part with rotary spindle are produced separately and then assembled. During assembly, the rotary spindle must be rapidly and very accurately rotated by means of a central recess in the holding element which was previously inserted into the outer sleeve, while the lower edge of the outer sleeve is made to simultaneously engage the base part.

Considerable forces are produced at this stage, which results in significant amounts of rejected product caused by damaged holding elements and damaged rotary spindles. Aside from economic loss stemming from the rejected product, there is additional cost entailed with the need for recycling of reject materials.

SUMMARY OF THE INVENTION

It is therefore an object of the present invention to reduce or eliminate damage during assembly with enhanced efficiency of production and economic savings thereby.

In accordance with the present invention, the outer sleeve and the holding element, are configured in the form of a plunger, in a one-part injection molding, with the plunger being firmly joined to the sleeve wall via predetermined breaking points.

As a result, only two assembly parts have to be combined with one another, namely the one-part injection molding with the plunger therein (arranged so as to be centered and whereby it cannot be tilted); and the base part with the rotary or threaded spindle.

In accordance with the present invention a stick of adhesive is produced with a rotatable plunger having a rotary spindle and a base part firmly joined thereto and which spindle supports the stick material. The spindle and stick material are in turn contained in a sleeve which is closed with a closure cap.

The sleeve and plunger are formed as a one-part injection molding, with the plunger being joined to the sleeve wall via predetermined breaking points. The base part, with rotary spindle, is adapted to be pushed through a recess, arranged so as to be centered, in the plunger until the lower sleeve periphery comes to rest against the upper part of the base part. The stick material is then poured into the unit thus formed, which comprises sleeve and base part with rotary spindle. After the filling operation is complete, the rotatable base part is actuated and, as a result, the plunger is lifted into the intended end position by means of the rotary spindle, with tearing off of the predetermined breaking points. The support plate of the plunger is pushed, by means of peripheral notches or grooves provided on it, onto guide webs provided on the inside of the sleeve wall, whereupon the closure cap is placed on the sleeve filled with adhesive.

The injection molding which forms the sleeve with plunger may very expediently be made of polypropylene.

Since the base part with the rotary spindle may be made of the same plastic as the sleeve or of a plastic compatible therewith, with the piston being firmly anchored in the sleeve and the rotation of the rotary spindle able to be carried out without damaging the sealing elements (such as the sealing lip of the spindle and sealing surface of the sleeve) there are several significant advantages. Not only is the assembly simplified as a result of the present invention, but the disposal of waste and reject material is also facilitated.

The invention also relates to an arrangement for carrying out the process described above, which arrangement is explained in greater detail with reference to the accompanying drawing, in which:

SHORT DESCRIPTION OF THE DRAWINGS

FIG. 1 shows a longitudinal section through a stick of adhesive before it is filled with stick material and FIG. 2 shows a top view in the center of the plunger.

DETAILED DESCRIPTION OF THE DRAWING AND THE PREFERRED EMBODIMENTS

Figure 1:
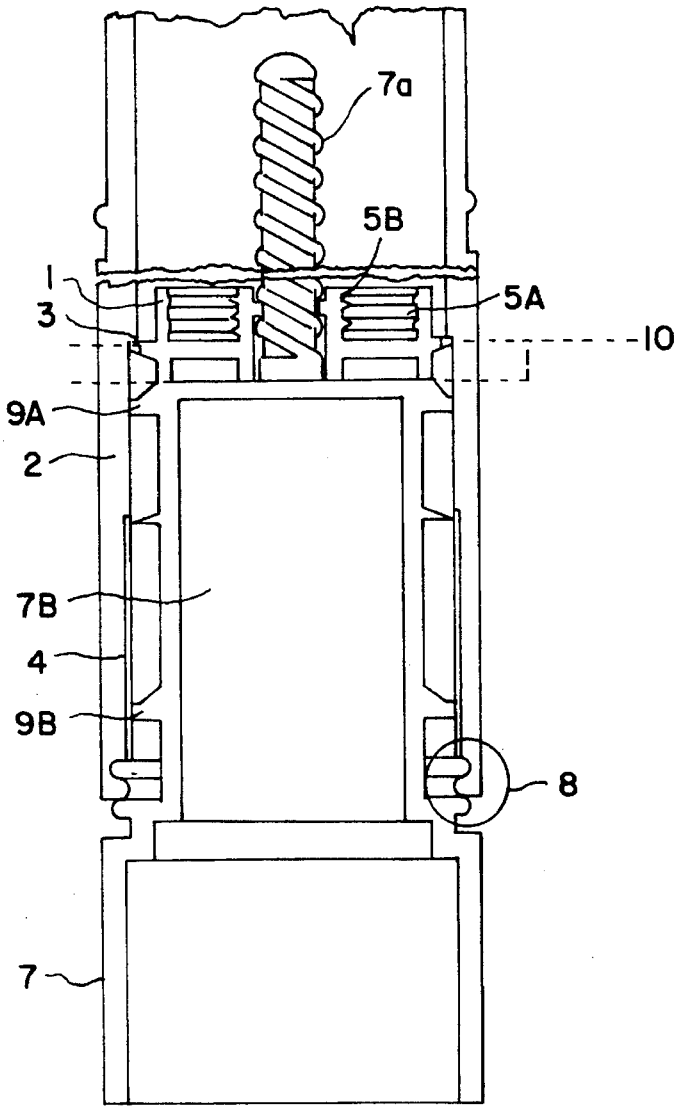
Figure 2:
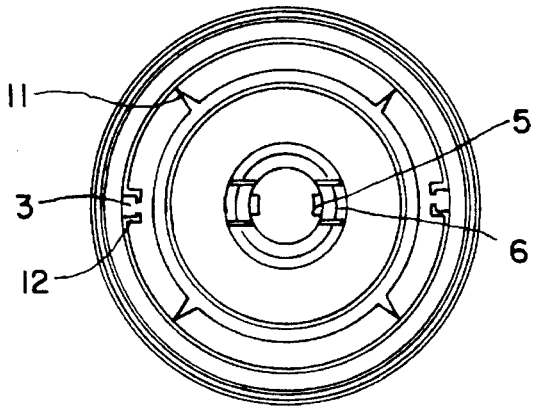

The arrangement according to the invention consists of:

(a) a rotatable base part (7) which is firmly joined, via a rotary element (7B), to a rotary spindle (7A), and having support plates (9A, 9B) which correspond to the clear diameter of the sleeve (2). The support plates (9A, 9B) are arranged at a distance from one another, (the support plate of the plunger and support plate of the rotary spindle respectively); and (b) a sleeve part (2), open at both ends, and having a plunger (1) which is firmly joined therein via predetermined breaking points (3). The plunger (1) has anchoring elements and support elements for the stick material, and is provided with a centrally located recess. The plunger (1) further has support vanes (11) on the outer periphery thereof, whereas guide webs (12) are provided on the inner wall of the sleeve part (2), extending in the longitudinal direction.

The plunger (1) is preferably designed in the form of a small basket which has on its inner wall threaded lugs (5A) and preferably also has threaded lugs (5B) on the outer wall of the central recess.

According to a further preferred embodiment of the invention, the recess, arranged so as to be centered, in the plunger (1) is formed from at least two elastic tongues (6) which are opposite one another and which simultaneously effect the engagement with rotary spindle (7A).

When the elements are in the adhesive filling position, at least one air channel (4) is expediently present between the inner wall of the sleeve and the part (7, 7A, 7B). After the part (7, 7A, 7B) has reached the end position (10), the air channel (4) is no longer connected to the space filled with the adhesive stick material.

Area (8) in FIG. 1 represents the engagement mechanism between the lower end of the sleeve (2) and the base part (7), which, when effected, results in a complete unit being formed which is ready to receive the adhesive stick material.

The support vanes (11) on the plunger periphery prevent a tilting movement of the plunger during rotating in of the rotary spindle, with the elastic tongues (6) further facilitating the rotating-in operation. The plunger (1) may of course also be designed in another way, for example as a plate with an anchoring disc arranged thereon or as a nut, only with threaded lugs on the inner wall. It is only necessary to take care that the stick material being filled in, can be readily rotated forwards and back again, together with the plunger, after it has set, without remaining adhered to the inner wall of the sleeve, that is to say the adhesive force of rest has to be overcome.

When the plunger is designed as a plate, with anchoring elements, the plate has to have a recess and an empty space disposed therebelow so that the stick material extends as far as the upper support plate and, as a consequence, itself contributes to the anchoring.

I claim:

1. A process for producing an adhesive stick comprising a rotatable base part with a rotary spindle, which is firmly joined thereto; a plunger for supporting an adhesive stick material, with said plunger having a centrally located recess; a sleeve surrounding the adhesive stick material; and a closure cap, said process comprising the steps of:

a) forming the sleeve and plunger together with a one-part injection molding, wherein the plunger is joined to a wall of the sleeve via predetermined breaking points, provided between the plunger and the sleeve wall;

b) bringing the base part together with the plunger whereby the rotary spindle of the base part is pushed through the recess in the plunger until a lower sleeve periphery of the plunger comes to rest against an upper part of the base part, whereby an adhesive retaining member is formed;

c) pouring the adhesive stick material into the retaining member;

d) actuating the rotatable base part, after filling of said retaining member with adhesive, whereby the plunger is lifted by support plate means on the rotary spindle into an intended end position, thereby breaking the predetermined breaking points; and wherein support plate means on the plunger is pushed, via peripheral notches or grooves on the plunger, onto guide webs provided on the inside of the sleeve wall; and e) placing the closure cap on the upper open end of the retaining member filled with adhesive.

* * * * *